US009249645B2

(12) United States Patent
Heijnen

(10) Patent No.: US 9,249,645 B2
(45) Date of Patent: Feb. 2, 2016

(54) APPARATUS FOR SEALING OFF A PART OF A WALL IN A SECTION DRILLED INTO AN EARTH FORMATION, AND A METHOD FOR APPLYING THE APPARATUS

(75) Inventor: Wilhelmus Hubertus Paulus Maria Heijnen, Stromberg (DE)

(73) Assignee: MAERSK OIL QATAR A/S, Copenhagen K (DK)

( * ) Notice: Subject to any disclaimer, the term of this patent is extended or adjusted under 35 U.S.C. 154(b) by 685 days.

(21) Appl. No.: 13/513,760

(22) PCT Filed: Dec. 2, 2010

(86) PCT No.: PCT/EP2010/068762

§ 371 (c)(1),
(2), (4) Date: Aug. 6, 2012

(87) PCT Pub. No.: WO2011/067347

PCT Pub. Date: Jun. 9, 2011

(65) Prior Publication Data

US 2013/0043049 A1 Feb. 21, 2013

Related U.S. Application Data

(60) Provisional application No. 61/266,790, filed on Dec. 4, 2009.

(30) Foreign Application Priority Data

Dec. 4, 2009 (DK) ..... 2009 70245

(51) Int. Cl.

| | |
|---|---|
| ***E21B 33/127*** | (2006.01) |
| ***E21B 33/12*** | (2006.01) |
| ***E21B 43/10*** | (2006.01) |

(52) U.S. Cl.
CPC ..... *E21B 33/1208* (2013.01); *E21B 33/127* (2013.01); *E21B 43/103* (2013.01)

(58) Field of Classification Search
USPC ..... 166/387, 381, 386, 277, 101, 179; 277/645, 605, 650–654
See application file for complete search history.

(56) References Cited

U.S. PATENT DOCUMENTS

| | | | |
|---|---|---|---|
| 2,271,005 | A | 1/1942 | Grebe |
| 3,926,254 | A | 12/1975 | Evans et al. |

(Continued)

FOREIGN PATENT DOCUMENTS

| | | | |
|---|---|---|---|
| DE | 2358371 | A1 | 5/1975 |
| EP | 1 223 305 | A2 | 7/2002 |

(Continued)

OTHER PUBLICATIONS

"The Development of Novel Down-Hole Intervention Tools, a Change in Well Technology (SPE 122822)", Proceedings of Offshore Europe, Sep. 8, 2009, pp. 1-14, XP055061112, DOI: 10.2118/122822-MS ISBN: 978-1-55-563261-8, the whole document.

(Continued)

*Primary Examiner* — Taras P Bemko
(74) *Attorney, Agent, or Firm* — Brinks Gilson & Lione

(57) ABSTRACT

The invention relates to an apparatus for sealing off a part of a wall (5) in a section (6) drilled into an earth formation and to be placed in such section (6), where said apparatus comprises elongate members (1) arranged along a closed curve, where adjacent elongate members (1) are connected via intermediate links (2), each link (2) being moveable from an unlocked position to a locked position. The invention further relates to a method for applying such an apparatus comprising the steps of:—positioning an apparatus in collapsed configuration in a section (6) drilled into an earth formation with a the wall (5) to be sealed off;—expanding a net or cage in the apparatus, which net or cage is formed by elongate members (1) connected by intermediate links (2);—expanding a flexible member (3) arranged at an outer diameter of the apparatus to seal against the wall (5).

20 Claims, 6 Drawing Sheets

(56) References Cited

U.S. PATENT DOCUMENTS

Figure 1:
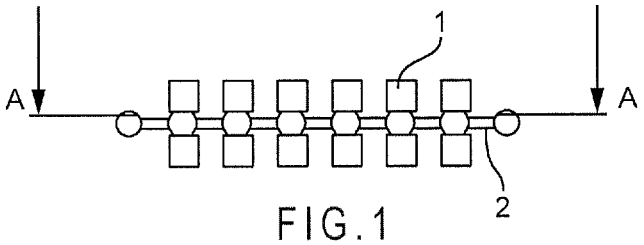

| | | | | |
|---|---|---|---|---|
| 3,937,278 | A | 2/1976 | Sheshtawy | |
| 4,320,800 | A | 3/1982 | Upchurch | |
| 4,365,676 | A | 12/1982 | Boyadjieff et al. | |
| 4,372,161 | A | 2/1983 | de Buda et al. | |
| 4,611,405 | A | 9/1986 | Van Steenwyk | |
| 4,621,532 | A | 11/1986 | Takagi et al. | |
| 4,919,223 | A | 4/1990 | Egger et al. | |
| 5,070,941 | A | 12/1991 | Kilgore | |
| 2,122,697 | A | 10/1995 | Potter | |
| 5,558,153 | A | 9/1996 | Holcombe et al. | |
| 5,758,731 | A | 6/1998 | Zollinger | |
| 5,955,666 | A | 9/1999 | Mullins | |
| 6,241,028 | B1 | 6/2001 | Biileveld et al. | |
| 6,241,031 | B1 | 6/2001 | Beaufort et al. | |
| 6,253,850 | B1 * | 7/2001 | Nazzai et al. | 166/277 |
| 6,478,097 | B2 | 11/2002 | Bloom et al. | |
| 6,679,341 | B2 | 1/2004 | Bloom et al. | |
| 6,845,819 | B2 | 1/2005 | Barrett et al. | |
| 7,059,417 | B2 | 6/2006 | Moore et al. | |
| 7,080,700 | B2 | 7/2006 | Bloom et al. | |
| 7,174,974 | B2 | 2/2007 | Bloom et al. | |
| 7,188,681 | B2 | 3/2007 | Bloom et al. | |
| 7,230,541 | B2 | 6/2007 | Ripolone et al. | |
| 7,353,886 | B2 | 4/2008 | Bloom et al. | |
| 7,392,859 | B2 | 7/2008 | Mock et al. | |
| 7,493,967 | B2 | 2/2009 | Mock et al. | |
| 7,607,495 | B2 | 10/2009 | Bloom et al. | |
| 7,607,497 | B2 | 10/2009 | Mock et al. | |
| 7,954,563 | B2 | 6/2011 | Mock et al. | |
| 8,069,917 | B2 | 12/2011 | Bloom et al. | |
| 8,109,331 | B2 | 2/2012 | Lynde et al. | |
| 8,151,902 | B2 | 4/2012 | Lynde et al. | |
| 8,245,796 | B2 | 8/2012 | Mock et al. | |
| 8,430,810 | B2 | 4/2013 | Hassidov et al. | |
| 8,555,963 | B2 | 10/2013 | Bloom et al. | |
| 8,602,115 | B2 | 12/2013 | Aguirre et al. | |
| 2001/0045300 | A1 | 11/2001 | Fincher et al. | |
| 2002/0007971 | A1 | 1/2002 | Beaufort et al. | |
| 2002/0029908 | A1 | 3/2002 | Bloom et al. | |
| 2002/0088648 | A1 | 7/2002 | Krueger et al. | |
| 2002/0096322 | A1 | 7/2002 | Barrett et al. | |
| 2002/0112859 | A1 | 8/2002 | Bloom et al. | |
| 2002/0190682 | A1 | 12/2002 | Schempf et al. | |
| 2003/0102164 | A1 | 6/2003 | Odell, II et al. | |
| 2003/0192707 | A1 | 10/2003 | Guven et al. | |
| 2004/0065445 | A1 * | 4/2004 | Abercrombie Simpson | E21B 23/01 166/382 |
| 2004/0090230 | A1 | 5/2004 | Appel et al. | |
| 2004/0144548 | A1 | 7/2004 | Bloom et al. | |
| 2004/0182580 | A1 | 9/2004 | Moore et al. | |
| 2004/0226746 | A1 | 11/2004 | Schmidt et al. | |
| 2004/0226747 | A1 | 11/2004 | Stegmaier et al. | |
| 2004/0262008 | A1 | 12/2004 | Deans et al. | |
| 2005/0150692 | A1 | 7/2005 | Ballantyne et al. | |
| 2005/0262944 | A1 | 12/2005 | Bennett et al. | |
| 2006/0180316 | A1 | 8/2006 | Steele et al. | |
| 2006/0196694 | A1 | 9/2006 | Bloom et al. | |
| 2007/0000693 | A1 | 1/2007 | Bloom et al. | |
| 2007/0256861 | A1 | 11/2007 | Hulick | |
| 2008/0066963 | A1 | 3/2008 | Sheiretov et al. | |
| 2008/0073077 | A1 | 3/2008 | Tunc et al. | |
| 2008/0121429 | A1 | 5/2008 | Bamford | |
| 2008/0159077 | A1 | 7/2008 | Madhavan et al. | |
| 2008/0211687 | A1 | 9/2008 | Price et al. | |
| 2008/0217059 | A1 | 9/2008 | Bloom et al. | |
| 2008/0308318 | A1 | 12/2008 | Moore | |
| 2009/0200290 | A1 | 8/2009 | Cardinal et al. | |
| 2009/0205840 | A1 | 8/2009 | O'Connor et al. | |
| 2009/0211754 | A1 | 8/2009 | Verret et al. | |
| 2009/0218105 | A1 | 9/2009 | Hill et al. | |
| 2010/0126716 | A1 | 5/2010 | Joseph | |
| 2010/0133006 | A1 | 6/2010 | Shakra et al. | |
| 2011/0067926 | A1 | 3/2011 | Moore | |
| 2012/0024539 | A1 | 2/2012 | Lehr | |
| 2012/0292049 | A1 | 11/2012 | Heijnen et al. | |
| 2014/0054031 | A1 | 2/2014 | Heijnen et al. | |

FOREIGN PATENT DOCUMENTS

| | | | |
|---|---|---|---|
| FR | 1 561 771 | A | 3/1969 |
| GB | 2234278 | A | 1/1991 |
| GB | 2275066 | A | 8/1994 |
| GB | 2 368 082 | A | 4/2002 |
| WO | 9812418 | | 3/1998 |
| WO | 0036266 | | 6/2000 |
| WO | 02070943 | A2 | 9/2002 |
| WO | 2008024881 | A1 | 2/2008 |

OTHER PUBLICATIONS

Search Report for DK application PA 2011 70110, Nov. 7, 2011.

Supplemental Search Report for DK application PA_2011_70110, Apr. 16, 2013.

PCT/EP2012/052447 International Search Report and Written Opinion, mailed Jul. 5, 2013.

PCT International-Type Search Report for DK 200901032, dated Apr. 7, 2010,4 pages.

Search Report for Application No. PA 200901032, dated Apr. 13, 2010, 1 page.

International Search Report for International Application No. PCT/EP2010/066376, dated Dec. 8, 2010.

International Search Report for PCT/EP2010/066233, mailed Feb. 16, 2011.

Written opinion for PCT/EP2010/066233, mailed Feb. 16, 2011.

International Preliminary Report on Patentability for International Application No. PCT/EP2010/066376, dated Nov. 30, 2011.

International Search Report for corresponding International application No. PCT/EP2010/068762, dated Feb. 7, 2011.

Written Opinion of the International Searching Authority for corresponding International application No. PCT/EP2010/068762, dated Feb. 7, 2011.

International Preliminary Report on Patentability for corresponding International application No. PCT/EP2010/068762, dated Nov. 17, 2011.

Search Report for Danish Application No. PA 2009 70180, completed Jun. 3, 2010.

* cited by examiner

APPARATUS FOR SEALING OFF A PART OF A WALL IN A SECTION DRILLED INTO AN EARTH FORMATION, AND A METHOD FOR APPLYING THE APPARATUS

RELATED APPLICATIONS

This application claims the benefit under 35 U.S.C. §371 of International Patent Application No. PCT/EP2010/068762, having an international filing date of Dec. 2, 2010, which claims priority to Danish Patent Application No. PA 2009 70245, filed Dec. 4, 2009, and U.S. Provisional Application No. 61/266,790, filed Dec. 4, 2009, the contents of all of which are incorporated herein by reference in their entirety.

The invention relates to an apparatus for sealing off a part of a wall in a section drilled into an earth formation and to be placed in the section drilled into the earth formation.

The invention further relates to a method for applying an apparatus for sealing off a part of a wall in a section drilled into an earth formation.

Equipment for closing off a fracture which transmits water from an injection well to a producer well, using an apparatus is known.

Such an apparatus is an apparatus introduced together with a tubing into a section drilled into an earth formation.

However this known equipment is not able to seal off an open hole which is not "nicely" formed at its wall. The geometry of such a hole can vary significantly depending on the "history" of the specific section drilled into an earth formation. For example the hole could have a larger diameter at some locations due to erosion caused by the production and/or injection, or the hole could have a shape which is not round due to "break out" of rock pieces from the wall. Known open hole packers require a more or less smooth and even hole to be able to seal off against the rock. Furthermore such a system can only be applied once.

The purpose of the invention is to provide an apparatus for sealing off a part of a wall in a section drilled into an earth formation which is able to seal off a section drilled into an earth formation with a not nicely formed wall.

Further the invention makes it possible to introduce further apparatuses for sealing off a part of a wall in a section drilled into an earth formation through an already placed and applied apparatus, thereby enabling a possibility of multiple setting of apparatuses in a section drilled into an earth formation without the need to use a conveying pipe.

The invention also makes it possible to seal off a number of sections in the section drilled into an earth formation.

Further is obtained, that the apparatus can be introduced into the section drilled into an earth formation through a tubing.

This is achieved by having an apparatus for sealing off a part of a wall in a section drilled into an earth formation and to be placed in the section drilled into the earth formation, said apparatus comprising a number of elongate members arranged substantially parallel along a closed curve, where adjacent elongate members are connected via a number of intermediate links, each link being moveable relative to the elongate members it is attached to from an unlocked position to a locked position.

An apparatus for sealing off a part of a wall in a section drilled into an earth formation where the length of the intermediate links and the number of elongate members are adapted to form an outer diameter of the apparatus in collapsed state, which outer diameter is smaller than the inner diameter of the apparatus being in an activated state, makes it possible to introduce a collapsed apparatus into the section drilled into an earth formation through an existing tubing and also if necessary through an already positioned apparatus.

An apparatus for sealing off a part of a wall in a section drilled into an earth formation where the elongate members are provided with locking means for holding the intermediate links in a position substantially perpendicular to the elongate members, provides a kind of stiff cage in expanded configuration. When the intermediate links are in locked position, meaning that they can not be moved in such a way that the distance between two neighbouring or two adjacent elongate members are reduced, they will provide the apparatus with a minimum collapse strength of the deployed device.

This is also achieved with an apparatus for sealing off a part of a wall in a section drilled into an earth formation where the locking member is formed by a groove or ridge extending in a direction substantially perpendicular to the longitudinal direction of the elongate members.

An apparatus for sealing off a part of a wall in a section drilled into an earth formation where an inflatable bag or bellows is arranged at the outer diameter of the apparatus to form a sealing member against the wall in the section drilled into an earth formation, makes it possible to the apparatus to seal efficiently against the wall of the drilled section. The bag or bellows is able to increase the outer diameter of the apparatus by up to more than twice the outer diameter of the net or cage, formed by the elongate members and the intermediate links, in expanded configuration.

An apparatus for sealing off a part of a wall in a section drilled into an earth formation where the elongate members is provided with ends sloping in a direction against the wall of the section drilled into an earth formation, allows passage of devices and further apparatuses i.e. to seal an area further down the drilled section. The sloping ends will then act like a kind of funnel directing equipment through the passage formed by the inner diameter of the apparatus.

An apparatus for sealing off a part of a wall in a section drilled into an earth formation where the apparatus is brought into applied position by inflating a bag or bellows arranged along the inner diameter of the apparatus formed by the elongate members connected with the intermediate links makes it possible to use an available kind of fluid to inflate the bag or bellows and thereby bringing the apparatus into applied position. Further it is possible to achieve a higher pressure using a liquid fluid than is a gas is used.

Examples of available fluids can be fluid from the section drilled in the earth formation or a fluid carried in a running tool.

By having an apparatus for sealing off a part of a wall in a section drilled into an earth formation where the intermediate links in unlocked position can be moved in a plane in the longitudinal direction of the elongate members it is possible to expand a kind of cage of elongate members by means of intermediate links.

An apparatus for sealing off a part of a wall in a section drilled into an earth formation where the intermediate links in unlocked position can be moved in a plane substantially perpendicular to the longitudinal direction of the elongate members makes it possible to make a more tight curve of the elongate members.

By having an apparatus according to the invention, it is possible to apply the apparatus in any geometry of a section drilled into an earth formation.

When an apparatus is installed, it will still be possible to allow passage of another or further apparatuses which can be set beyond the apparatus passed.

The apparatus can be provided with an arrangement for deflating the outer bag or bellows by punching a hole in the bag or bellows or by deflating the bag or bellows by letting out the media enclosed in the bag or bellows, i.e. through a valve or another closable opening.

The apparatus obtains due to its configuration a reliable collapse resistance, thereby making it possible to maintain an applied sealing using the apparatus.

It is also achieved by a method for applying an apparatus for sealing off a part of a wall in a section drilled into an earth formation comprising the steps of:

positioning an apparatus for sealing off a part of a wall in a section drilled into an earth formation with respect to a part of the wall to be sealed of, the apparatus being positioned in collapsed configuration;

expanding a net or cage in the apparatus, which net or cage is formed by a number of elongate members connected by intermediate links;

expanding a flexible member arranged at an outer diameter of the apparatus to seal against the wall in the section drilled in the earth formation.

The method where a further apparatus for sealing off a part of a wall in a section drilled into an earth formation is introduced in collapsed configuration through an inner diameter of an already deployed apparatus makes it possible to apply further sealing to other parts of the wall in a section drilled in an earth formation.

This is also obtained by a method where a further apparatus for sealing off a part of a wall (5) in a section (6) drilled into an earth formation is introduced in collapsed configuration through a tubing further downhole the drilled section than an already deployed apparatus.

Figure 2:
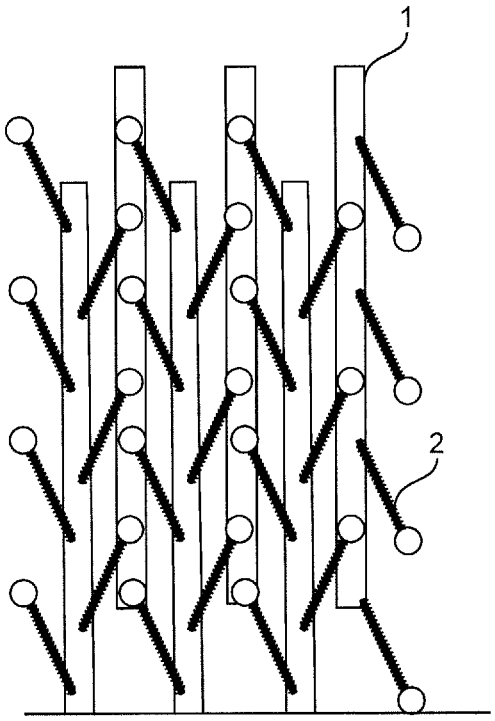
Figure 3:
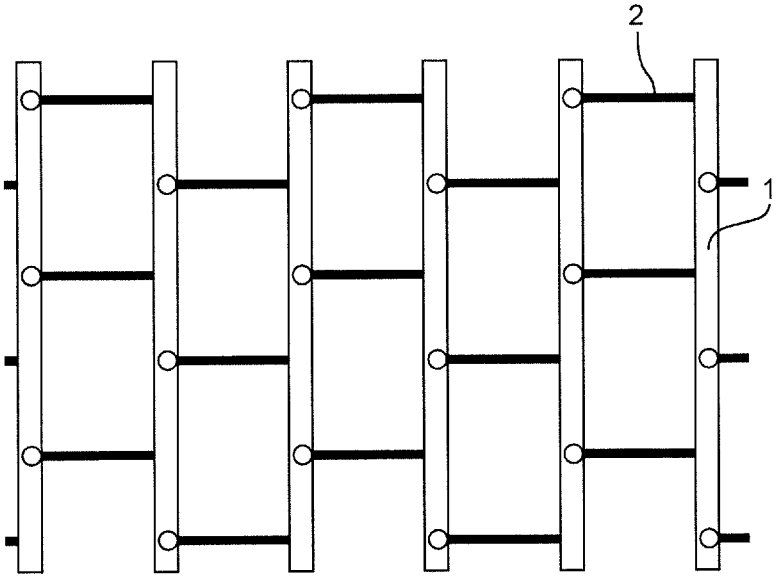
Figure 4:
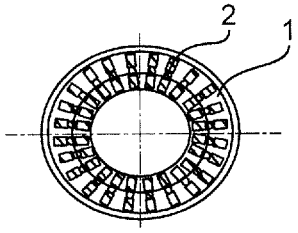
Figure 5:
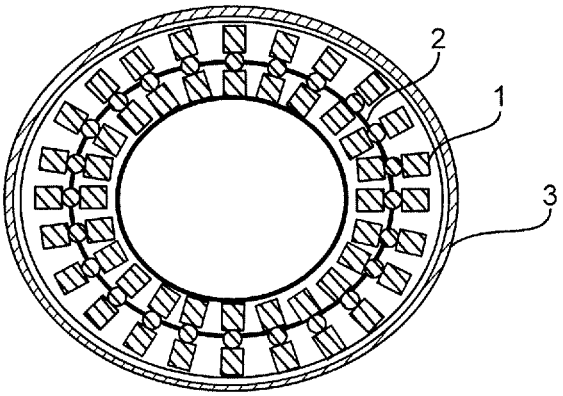
Figure 6:
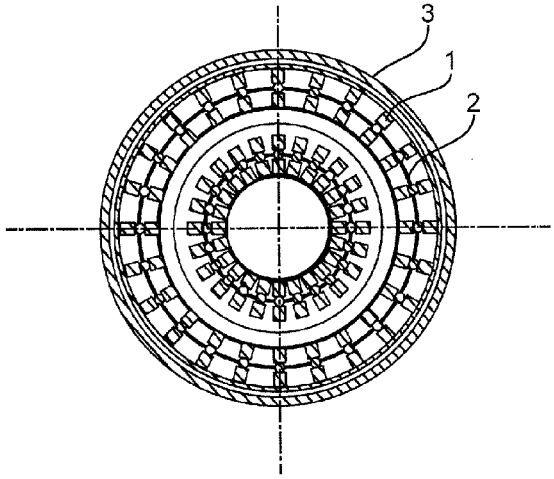
Figure 7:
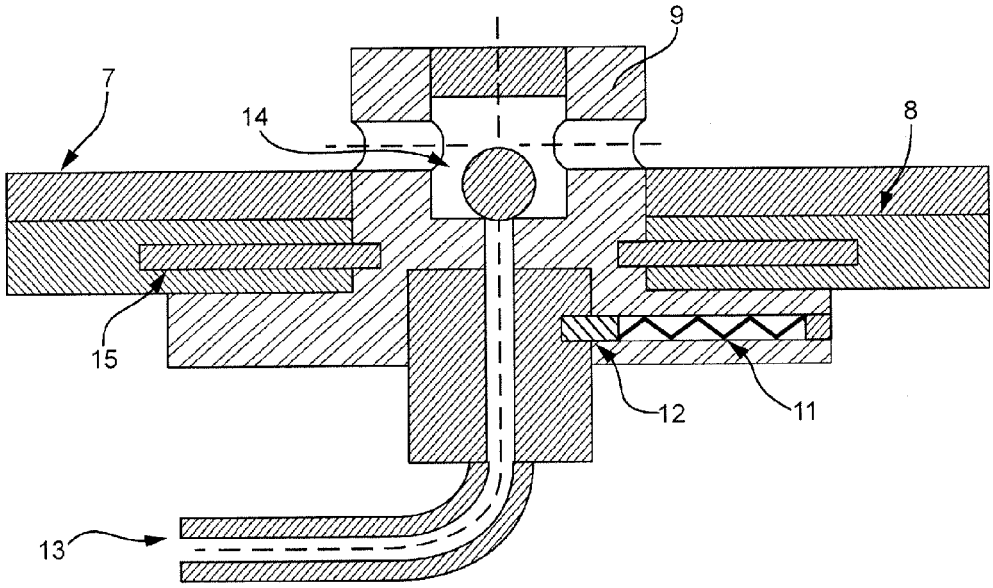
Figure 8:
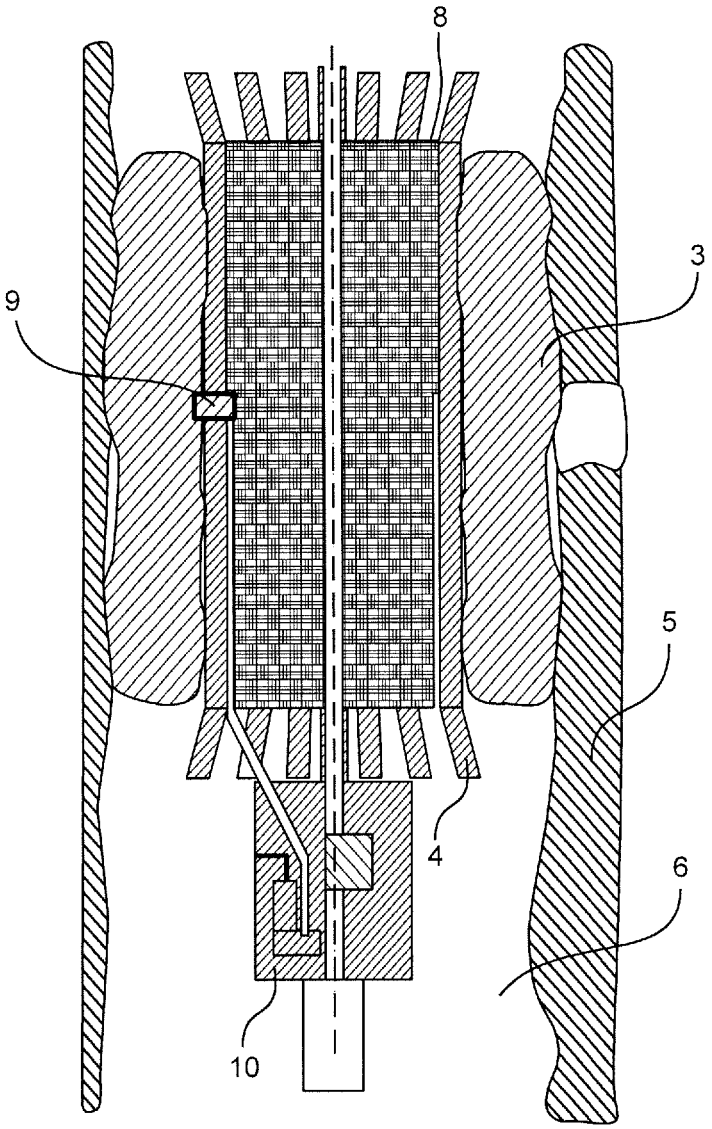
Figure 9:
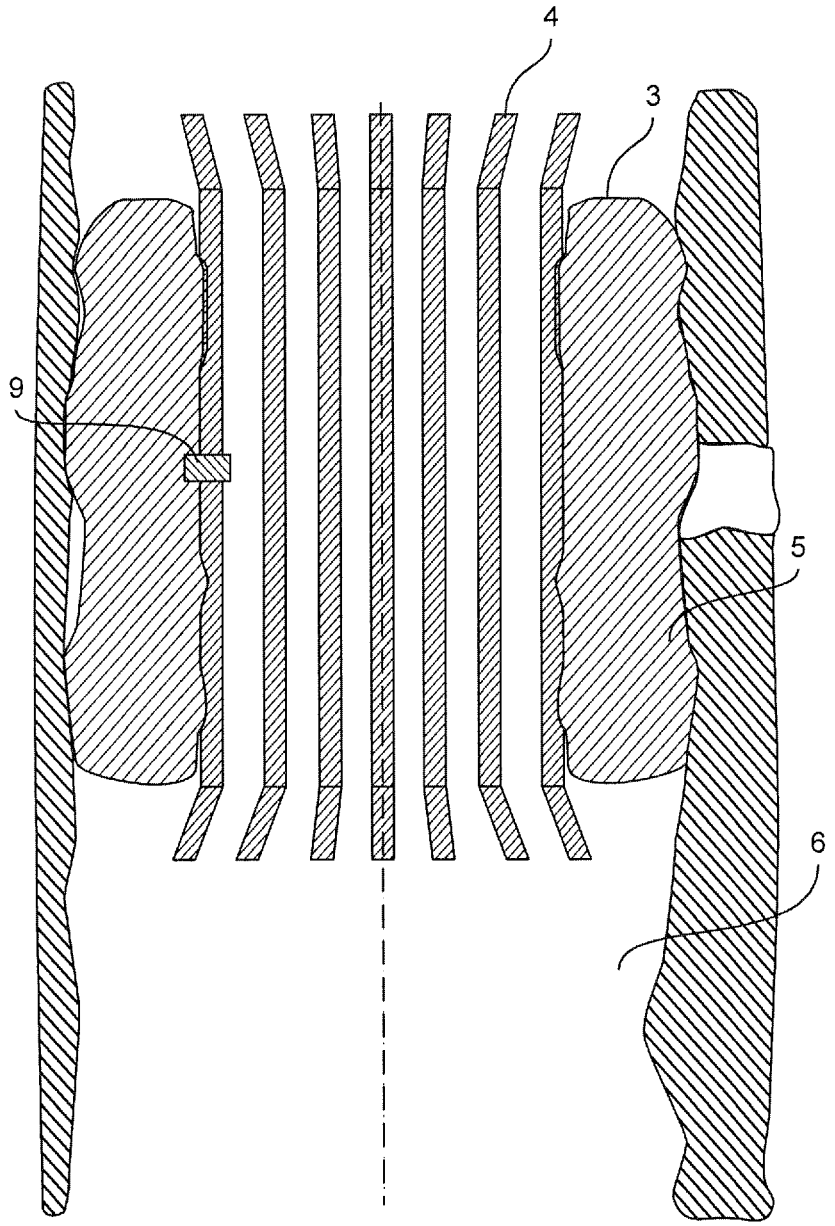
Figure 10:
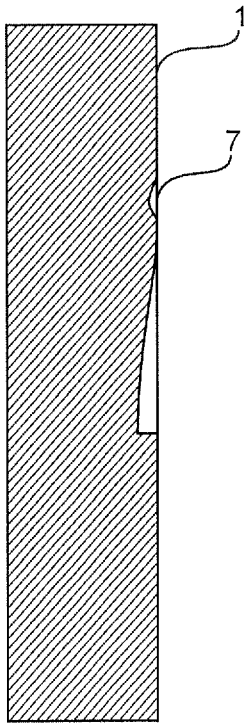
Figure 11:
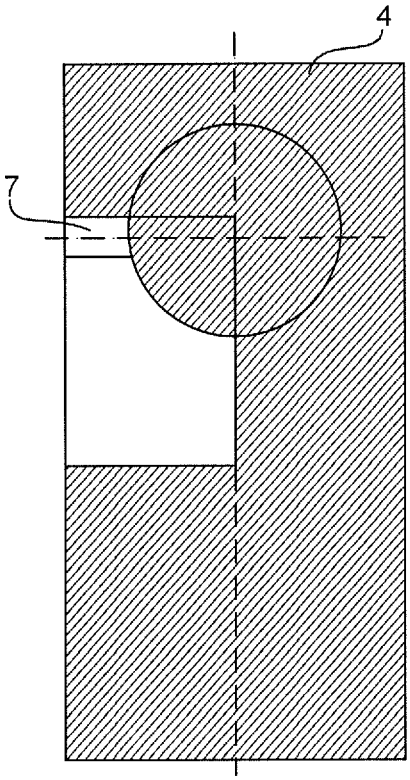

In the following different embodiments of the invention is described with reference to the drawings, where FIG. 1 schematically shows a part of a net or cage of elongate members where the elongate members are connected via intermediate links being able to rotate therewith increasing the distance between the elongate members, the part of the net is seen from an end;

FIG. 2 schematically shows the net or cage in FIG. 1 seen in sectional view A-A;

FIG. 3 schematically shows a part of the net in FIGS. 1 and 2 in an expanded position;

FIG. 4 schematically shows an assembled net or cage in collapsed position;

FIG. 5 schematically shows a net or cage in expanded position;

FIG. 6 schematically shows a collapsed net or cage placed inside a net or cage in expanded position, the outer circles represent the bag or bellows which is to be inflated and thereby sealing against the well bore wall in a final setting position;

FIG. 7 schematically shows a valve to be used during inflation of the bag or bellows;

FIG. 8 schematically shows the apparatus, including a running tool, the apparatus being in the expanded position;

FIG. 9 schematically shows the apparatus when installed in a section drilled in an earth formation, the intermediate links are not shown;

FIG. 10 schematically shows a side view of a sectional cut through the middle of an embodiment of an elongate member, where an intermediate link(not shown) is to be positioned and locked; and FIG. 11 schematically shows a front view of a sectional cut through the middle of an embodiment of an elongate member, where an intermediate link(not shown) is to be positioned and locked.

Now different embodiments of the invention will be described.

In an embodiment of an apparatus for sealing off a part of a wall 5 in a section 6 drilled into an earth formation and to be placed in the section 6 drilled into the earth formation, the apparatus comprises a number of elongate members 1 arranged substantially parallel along a closed curve, where adjacent elongate members 1 are connected via a number of intermediate links 2, each link 2 being moveable relative to the elongate members 1 it is attached to from an unlocked position to a locked position. FIGS. 1 and 2 shows a part of a net or cage of elongate members 1 connected with intermediate links 2 in collapsed configuration and FIG. 3 shows the same in an expanded position.

In a further embodiment the intermediate links 2 can be locked in collapsed position.

In another embodiment the intermediate links 2 are held in collapsed position during insertion of the apparatus by means of a flexible member 3.

In yet an embodiment the flexible member 3 is an outer bag or bellows 3.

In another embodiment the apparatus for sealing off a part of a wall 5 in a section 6 drilled into an earth formation and to be placed in the section 6 drilled into the earth formation, the length of the intermediate links 2 and the number of elongate members 1 are adapted to form an outer diameter of the apparatus in collapsed state, which outer diameter is smaller than the inner diameter of the apparatus being in an activated state as shown in FIGS. 4, 5 and 6. This makes it possible to introduce a collapsed apparatus into the section 6 drilled into an earth formation through an existing tubing and also if necessary through an already positioned apparatus.

In a further embodiment of an apparatus for sealing off a part of a wall 5 in a section 6 drilled into an earth formation and to be placed in the section 6 drilled into the earth formation, the elongate members 1 are provided with locking means for holding the intermediate links 2 in a position substantially perpendicular to the elongate members 1. This provides a kind of stiff cage in expanded configuration. When the intermediate links 2 are in locked position, meaning that they can not be moved in such a way that the distance between two neighbouring or two adjacent elongate members 1 are reduced, they will provide the apparatus with a minimum collapse strength of the deployed device.

This is also achieved in an embodiment where an apparatus for sealing off a part of a wall 5 in a section 6 drilled into an earth formation and to be placed in the section 6 drilled into the earth formation, has a locking member 7 formed by a groove or ridge 7 extending in a direction substantially perpendicular to the longitudinal direction of the elongate members 1.

In an embodiment of an apparatus for sealing off a part of a wall 5 in a section 6 drilled into an earth formation and to be placed in the section 6 drilled into the earth formation, an inflatable bag or bellows 3 is arranged at the outer diameter of the apparatus to form a sealing member against the wall 5 in the section 6 drilled into an earth formation. Hereby it is possible to the apparatus to seal efficiently against the wall 5 of the drilled section 6. The bag or bellows 3 is able to increase the outer diameter of the apparatus by up to more than twice the outer diameter of the cage in expanded configuration.

In further an embodiment of an apparatus for sealing off a part of a wall 5 in a section 6 drilled into an earth formation and to be placed in the section 6 drilled into the earth formation, elongate members 1 is provided with ends sloping in a direction against the wall 5 of the section 6 drilled into an earth formation. Hereby is acquired passage for devices and further apparatuses i.e. to seal an area further down the drilled section 6. The sloping ends will then act like a kind of funnel directing equipment through the passage formed by the inner diameter of the apparatus.

In yet an embodiment of an apparatus for sealing off a part of a wall 5 in a section 6 drilled into an earth formation and to be placed in the section 6 drilled into the earth formation, the apparatus is brought into applied position by inflating a bag or bellows 8 arranged along the inner diameter of the apparatus formed by the elongate members 1 connected with the intermediate links 2. This makes it possible to use an available kind of fluid to inflate the bag or bellows 8 and thereby bringing the apparatus into applied position. Further it is possible to achieve a higher pressure using water or another fluid in stead of a gas or simply atmospheric air. It is possible to use gas or air, but a liquid fluid is able to achieve higher pressure.

Examples of available fluids can be fluid from the section 6 drilled in the earth formation or a fluid carried in a running tool 10.

Alternatively any fluid or gas or epoxy or foam can be used to fill the outer bag or bellows 3.

In an embodiment of an apparatus for sealing off a part of a wall 5 in a section 6 drilled into an earth formation and to be placed in the section 6 drilled into the earth formation, the intermediate links 2 in unlocked position can be moved in a plane in the longitudinal direction of the elongate members 1, thereby making it possible to expand a kind of cage of elongate members 1 by means of intermediate links 2.

In another embodiment of an apparatus for sealing off a part of a wall 5 in a section 6 drilled into an earth formation and to be placed in the section 6 drilled into the earth formation, the intermediate links 2 in unlocked position can be moved in a plane substantially perpendicular to the longitudinal direction of the elongate members 1 makes it possible to make a more tight curve of the elongate members 1.

By having an apparatus according to the invention, it is possible to apply the apparatus in any geometry of a section 6 drilled into an earth formation.

The apparatus acquires due to its configuration a reliable collapse resistance, thereby making it possible to maintain an applied sealing using the apparatus.

When an apparatus is installed, it will still be possible to allow passage of another or further apparatuses which can be set beyond the apparatus passed.

It is possible to manufacture the apparatus of almost any length. The only limitation is the maximum running length, determined by the wireline lubricator length.

It is also possible to position apparatuses closely next to each other.

An apparatus can be disabled by simply punching a hole in the outer bag or bellows 3.

The apparatus can be provided with an arrangement for deflating the outer bag or bellows 3 by punching a hole in the bag or bellows 3 or by deflating the bag or bellows 3 by letting out the media enclosed in the bag or bellows 3, i.e. through a valve or another kind of closable opening 9.

This is achieved by having an apparatus for sealing off a part of a wall 5 in a section 6 drilled into an earth formation and to be placed in the section 6 drilled into the earth formation, said apparatus comprising a number of elongate members 1 arranged substantially parallel along a closed curve, where adjacent elongate members 1 are connected via a number of intermediate links 2, each link 2 being moveable relative to the elongate members 1 it is attached to from an unlocked position to a locked position.

An apparatus for sealing off a part of a wall 5 in a section 6 drilled into an earth formation and to be placed in the section 6 drilled into the earth formation, where the length of the intermediate links 2 and the number of elongate members 1 are adapted to form an outer diameter of the apparatus in collapsed state, which outer diameter is smaller than the inner diameter of the apparatus being in an activated state, makes it possible to introduce a collapsed apparatus into the section 6 drilled into an earth formation through an already positioned apparatus.

Further it makes it possible to introduce the apparatus through the tubing and into the well.

An apparatus for sealing off a part of a wall 5 in a section 6 drilled into an earth formation and to be placed in the section 6 drilled into the earth formation, where the elongate members 1 are provided with locking means for holding the intermediate links 2 in a position substantially perpendicular to the elongate members 1, provides a kind of stiff cage in expanded configuration. When the intermediate links 2 are in locked position, meaning that they can not be moved in such a way that the distance between two neighbouring or two adjacent elongate members 1 are reduced, they will provide the apparatus with a minimum collapse strength of the deployed device.

In an embodiment of the invention the material from which the intermediate link members are selected has a minimum of collapse strength of the deployed device in excess of 35 bar.

In another embodiment of the invention the whole assembly can run on coil tubing (2" OD), small drill pipe (3½" OD) or tractor. The apparatus can be equipped with one or more electric cables or batteries to make it possible to use electric current as an energy source.

FIG. 10 schematically shows a side view of a sectional cut through the middle of an embodiment of an elongate member, where an intermediate link (not shown) is to be positioned and locked; and FIG. 11 schematically shows a front view of a sectional cut through the middle of an embodiment of an elongate member, where an intermediate link (not shown) is to be positioned and locked.

In an embodiment a hydraulic pump (not shown) can provide the apparatus with well fluids (oil, water or a mixture) via a filter to inflate up the outer bag or bellows 3. A similar arrangement (not shown) is used to inflate the inner bag or bellows 8 to expand the net as shown in FIG. 8.

When inflating the outer bag or bellows 3 a valve 9 can be used. The valve 9 is connected to the apparatus by a spring activated 11 shear pin 12. The shear pin 12 will fail at a predetermined internal pressure and a flexible steel pipe 13 will be 'pushed' out by that pressure. The valve 9 is provided with a reinforcement 15 extending into the inner bellows 8 so that the valve will not detach from the inner bellows 8.

After the full expansion pressure is achieved, more pressure is applied to detach the hydraulic line 13 of the running tool 10 from the external bag or bellows 3. A back flow valve 14 together with the shear pin 12 ensures that a certain pressure is achieved and that the fluid pressure will not decrease in the bag or bellows 3 when the hydraulic line 13 is detached.

When the pressure is increased and the shear pin 12 is sheared, the inner bag or bellows 8 is deflated and the running tool 10 is then retracted.

The invention also relates to a method for applying an apparatus for sealing off a part of a wall 5 in a section 6 drilled into an earth formation comprising the steps of:

positioning an apparatus for sealing off a part of a wall 5 in a section 6 drilled into an earth formation with respect to a part of the wall 5 to be sealed of, the apparatus being positioned in collapsed configuration;

expanding a net or cage in the apparatus, which net or cage is formed by a number of elongate members 1 connected by intermediate links 2;

expanding a flexible member 3 arranged at an outer diameter of the apparatus to seal against the wall 5 in the section 6 drilled in the earth formation.

The method further describes an embodiment where a further apparatus for sealing off a part of a wall 5 in a section 6 drilled into an earth formation is introduced in collapsed configuration through an inner diameter of an already deployed apparatus.

In another embodiment of the method a further apparatus for sealing off a part of a wall 5 in a section 6 drilled into an earth formation is introduced in collapsed configuration through a tubing further downhole the drilled section than an already deployed apparatus.

The invention claimed is:

1. An apparatus for sealing off an opening in part of a wall in a section drilled into an earth formation and to be placed in the section drilled into the earth formation, said apparatus comprising:

a number of elongate members arranged substantially parallel along a closed curve, where adjacent elongate members are connected via a number of intermediate links, each link being moveable relative to the elongate members it is attached to from an unlocked position to a locked position; and an inflatable bag or bellows arranged about the outer diameter of the apparatus to form a sealing member against the wall in the section drilled into an earth formation, wherein when the apparatus is in a locked position, and the inflatable bag or bellows is inflated, the apparatus is configured to seal the opening in the wall to prevent fluid flow through the opening; and wherein the inflatable bag or bellows is further configured to be subsequently deflated to re-allow fluid flow through the opening.

2. An apparatus according to claim 1, characterized in that the length of the intermediate links and the number of elongate members are adapted to form an outer diameter of the apparatus in collapsed state, which outer diameter is smaller than the inner diameter of the apparatus being in an activated state.

3. An apparatus according to claim 2, characterized in that the elongate members are provided with locking means for holding the intermediate links in a position substantially perpendicular to the elongate members.

4. An apparatus according to claim 2, characterized in that the elongate members is provided with ends sloping in a direction against the wall 5 of the section drilled into an earth formation.

5. An apparatus according to claim 2, characterized in that the apparatus is brought into applied position by inflating a bag or bellows arranged along the inner diameter of the apparatus formed by the elongate members connected with the intermediate links.

6. An apparatus according to claim 2, characterized in that the intermediate links can in unlocked position be moved in a plane in the longitudinal direction of the elongate members.

7. An apparatus according to claim 2, characterized in that the intermediate links in unlocked position can be moved in a plane substantially perpendicular to the longitudinal direction of the elongate members.

8. An apparatus according to claim 1, characterized in that the elongate members are provided with locking means for holding the intermediate links in a position substantially perpendicular to the elongate members.

9. An apparatus according to claim 8, characterized in that the locking member is formed by a groove or ridge extending in a direction substantially perpendicular to the longitudinal direction of the elongate members.

10. An apparatus according to claim 8, characterized in that the elongate members is provided with ends sloping in a direction against the wall 5 of the section drilled into an earth formation.

11. An apparatus according to claim 8, characterized in that the apparatus is brought into applied position by inflating a bag or bellows arranged along the inner diameter of the apparatus formed by the elongate members connected with the intermediate links.

12. An apparatus according to claim 8, characterized in that the intermediate links can in unlocked position be moved in a plane in the longitudinal direction of the elongate members.

13. An apparatus according to claim 8, characterized in that the intermediate links in unlocked position can be moved in a plane substantially perpendicular to the longitudinal direction of the elongate members.

14. An apparatus according to claim 1, characterized in that the elongate members are provided with ends sloping in a direction against the wall 5 of the section drilled into an earth formation.

15. An apparatus according to claim 1, characterized in that the apparatus is brought into applied position by inflating a bag or bellows arranged along the inner diameter of the apparatus formed by the elongate members connected with the intermediate links.

16. An apparatus according to claim 1, characterized in that the intermediate links can in unlocked position be moved in a plane in the longitudinal direction of the elongate members.

17. An apparatus according to claim 1, characterized in that the intermediate links in unlocked position can be moved in a plane substantially perpendicular to the longitudinal direction of the elongate members.

18. A method for applying an apparatus for sealing off an opening in part of a wall in a section drilled into an earth formation comprising the steps of:

positioning an apparatus for sealing off a part of a wall in a section drilled into an earth formation with respect to a part of the wall to be sealed of, the apparatus being positioned in collapsed configuration;

expanding a net or cage in the apparatus, which net or cage is formed by a number of elongate members connected by intermediate links;

inflating an outer bag or bellows arranged about an outer diameter of the apparatus to seal against the wall in the section drilled in the earth formation to thereby seal the opening in the wall to prevent fluid flow through the opening; and subsequently contracting the outer bag or bellows to re-allow fluid flow through the opening.

19. A method according to claim 18, characterized in that a further apparatus for sealing off a part of a wall in a section drilled into an earth formation is introduced in collapsed configuration through an inner diameter of an already deployed apparatus.

20. A method according to claim 18, characterized in that a further apparatus for sealing off a part of a wait in a section drilled into an earth formation is introduced in collapsed configuration through a tubing further downhole the drilled section than an already deployed apparatus.

* * * * *